US006811673B2

(12) United States Patent
Brodt et al.

(10) Patent No.: US 6,811,673 B2
(45) Date of Patent: Nov. 2, 2004

(54) METHOD FOR ELECTROLYTIC GALVANIZING USING ELECTROLYTES CONTAINING ALKANE SULPHONIC ACID

(75) Inventors: Gregor Brodt, Heppenheim (DE); Jens Haas, Gielert (DE); Werner Hesse, Obrigheim (DE); Hans-Ulrich Jäger, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/332,578

(22) PCT Filed: Jul. 9, 2001

(86) PCT No.: PCT/EP01/07876

§ 371 (c)(1),
(2), (4) Date: Jan. 10, 2003

(87) PCT Pub. No.: WO02/04713

PCT Pub. Date: Jan. 17, 2002

(65) Prior Publication Data

US 2003/0141195 A1 Jul. 31, 2003

(30) Foreign Application Priority Data

Jul. 10, 2000 (DE) ..... 100 33 433

(51) Int. Cl.[7] ..... C25D 3/56; C25D 3/22; C23C 20/00

(52) U.S. Cl. ..... 205/244; 205/311; 106/1.29

(58) Field of Search ..... 205/244, 311; 106/1.29

(56) References Cited

U.S. PATENT DOCUMENTS 4,100,040 A * 7/1978 Rosenberg ..... 205/312
4,207,150 A 6/1980 Creutz et al. ..... 204/55 R
4,923,573 A * 5/1990 Florian ..... 205/101
5,616,232 A 4/1997 Nakazawa et al. ..... 205/155

FOREIGN PATENT DOCUMENTS

| | | | |
|---|---|---|---|
| EP | 727 512 | 8/1996 | |
| EP | 786 539 | 7/1997 | |
| EP | 807 697 | 11/1997 | |
| GB | 2062010 A * | 5/1981 | ..... C25D/3/22 |
| GB | 2188334 | 9/1987 | |

OTHER PUBLICATIONS

Martyak et al., "High Speed Zinc Galvanizing From A Methanesulfonate Solution", The Minerals, Metal & Materials Society (no month, 1998), pp. 293–301.*

XP–002201567=US 6,176,996B1 Jan. 23, 2001.

Zinc–Based SteelCoating Systems, Martyak et al. 293–301, no month, 1998.

* cited by examiner

*Primary Examiner*—Edna Wong
(74) *Attorney, Agent, or Firm*—Keil & Weinkauf

(57) ABSTRACT

Matt surfaces are obtained when a metal is coated electrolytically with zinc from an electrolyte solution which contains zinc sulfate or an alkanesulfonate of zinc or mixtures thereof, and optionally further metal salts, sulfuric acid or an alkanesulfonic acid or a mixture thereof, and at least one additive selected from nitrogen-containing surface-active compounds, which may be ionic or nonionic, sulfur-containing anionic surface-active compounds, and surface-active compounds based on multifunctional alcohols having at least three hydroxyl groups.

16 Claims, 5 Drawing Sheets

50 μm

50 μm

METHOD FOR ELECTROLYTIC GALVANIZING USING ELECTROLYTES CONTAINING ALKANE SULPHONIC ACID

This application is a 371 of PCT/EP01/07876 filed Jul. 9, 2001

The present invention relates to a process for the electrolytic coating of metals with zinc or a zinc alloy, to an electrolyte composition for the electrolytic coating of steel or iron with zinc or zinc alloys, and to the use of additives for improving the surface roughness and preventing dendritic edge growth in the electrolytic coating of metals with zinc or a zinc alloy.

TECHNICAL FIELD

Zinc coatings offer very good protection against atmospheric influences and are employed for the protection of metals against corrosion. The galvanization of metals, in particular iron or steel, is used on a large scale, for example for the automobile sector. In addition, wires, for example for the electronics industry, belts and tubes are also galvanized on a large scale.

The corresponding workpieces are often zinc plated, since this has advantages over other galvanization processes, such as hot-dip galvanization, sherardization and spraying methods:

a) free choice of the thickness of the zinc layer;
b) no formation of brittle, intermetallic compounds at the iron/zinc interface;
c) low energy requirement;
d) no change in the workpieces due to the effects of heat;
e) no production of hard zinc or zinc ash;
f) clean working, since the galvanization is carried out at relatively low temperatures between room temperature and about 70° C. and no health-damaging vapors are released;
g) more uniform zinc coatings.

Zinc plating can be carried out either in acidic or in alkaline/cyanide electrolytes. Cyanide-based zinc electrolytes give smooth, finely crystalline precipitates. The throwing power of these baths is very good, but the current yield is poor, i.e. electrolysis can only be carried out at relatively low current densities. However, the current density is proportional to the coating rate. It is therefore desirable, for economic reasons, to carry out the electrolysis at the highest possible current densities and thus to obtain the fastest possible zinc deposition.

In the area of continuous strip galvanization, for example for the automobile industry, and the galvanization of wires, strips and tubes, preference is given to acidic electrolytes since fast zinc deposition is possible as a consequence of the ability to use high current densities of up to 200 A/dm$^2$ at the same time as adequate mobility of the electrolyte and a current yield of virtually 100%. The electrolytes usually used are based on chloride or sulfate.

However, the high current densities result in numerous problems in electrolytic galvanization. Thus, increased edge roughness of the galvanized workpieces is observed owing to dendrite growth and "burn" of the edges. Zinc dendrites broken off during the galvanization or during subsequent treatment of the workpieces also damage the remaining galvanized surface. Furthermore, high current densities cause increased roughness of the entire zinc layer, which may result, inter alia, in problems in applying further layers and also in reduced repulsion of oil or other lubricants used in shaping of the galvanized workpieces, for example in the automobile industry. Finally, grain growth of the zinc layer is difficult to control at high current densities.

In spite of all these disadvantages, high current densities are desirable in electrolytic galvanization owing to the high coating rate.

BACKGROUND ART

Numerous processes which propose possible solutions to the problems which occur in electrolytic galvanization at high current densities are known from the prior art.

U.S. Pat. No. 4,207,150 discloses aqueous cyanide-free electrolytes for electrolytic galvanization which contain a water-soluble zinc salt and in which a quaternary butyl nicotinate salt is employed as brightening and leveling additive. In addition, polyether is preferably additionally employed as brightening agent and methanesulfonic acid and its salts as leveling agent. The advantages of the additives employed can be observed at pH values of from 2 to 7.5.

U.S. Pat. No. 5,616,232 relates to a process for the electrolytic deposition of zinc/chromium alloys in an acidic electrolyte. As additives, use is made of polyethyleneoxyphenol derivatives, which promote deposition of the zinc/chromium alloy.

EP-A 0 727 512 relates to the electrolytic deposition of zinc at high current densities. In this process, an electrolyte is employed which comprises zinc sulfate in an aqueous, acidic electrolysis bath. In this electrolysis bath, the formation of dendrites and edge burn of the workpiece and the roughness of the zinc surface are reduced and the grain size is controlled. As additives, high-molecular-weight polyoxyalkylene glycols are added to the electrolyte as grain size reducers in combination with sulfonated products of the condensation of naphthalene and formaldehyde as antidendritic reagents.

EP-A 0 807 697 relates to electrolytes for electrodeposition of zinc at high current densities and a pH of from 2 to 5 which are said to reduce the usual problems which occur at these current densities. These electrolytes essentially consist of a zinc salt selected from zinc sulfate and/or an organozinc sulfate, and a polyoxyalkylene glycol of low molecular weight based on alkylene oxides having 2 to 4 carbon atoms, an aromatic sulfonate and a conductivity-increasing salt, preferably a potassium salt.

EP-A 0 786 539 likewise relates to electrolytes for electrodeposition of zinc at high current densities which are said to reduce the usual problems which occur at these current densities. Use is made here of an electrolyte based on methanesulfonic acid and a water-soluble organozinc sulfonate. At a pH of >2.5, the use of additional additives is unnecessary, while at a pH of from 1.5 to 2.5, an additive is additionally necessary. This additive is a polyoxyalkylene glycol homopolymer or copolymer based on alkylene oxides having 2 to 4 carbon atoms. Furthermore, the electrolytes in accordance with this application may additionally optionally comprise water-soluble boron oxide compounds, lignin compounds and/or a sulfonated product of the condensation of naphthalene and formaldehyde.

"Zinc-Based Steel Coating Systems: Production and Performance"; edited by F. E. Goodwin, The Minerals, Metals & Materials Society, 1998, pages 293 to 301, describes the advantages of zinc/methanesulfonic acid electrolytes compared with classical zinc sulfate electrolytes. However, fine-grained zinc surfaces are only obtained on use of a grain size reducer which modifies the microstructure and orientation of the deposited zinc surface. No details are given on the grain size reducer employed.

Thus, a suitable electrolyte system for the deposition of zinc or zinc alloys at high current densities (high-speed deposition) which reduces or completely prevents the disadvantages in high-speed deposition in a simple manner in a broad pH range and current density range is still desirable.

It is an object of the present invention to provide a process for the electrolytic deposition of zinc or zinc alloys at high current densities which reduces or prevents the disadvantages which occur in the prior art, such as increased edge roughness of the galvanized workpieces owing to dendrite growth and edge burn, increased roughness of the entire zinc layer and problems in controlling grain growth of the zinc layer.

DISCLOSURE OF THE INVENTION

We have found that this object is achieved by a process for the electrolytic coating of metals with zinc or a zinc alloy in which matt surfaces are obtained, by deposition of zinc from an electrolyte solution comprising a zinc salt selected from zinc sulfate or an alkanesulfonate of zinc or mixtures thereof, and, if desired, further metal salts, an acid selected from sulfuric acid or an alkanesulfonic acid or a mixture of the two acids, and at least one additive for improving the surface roughness and preventing dendritic edge growth, selected from nitrogen-containing surface-active compounds, which may be ionic or nonionic, sulfur-containing anionic surface-active compounds, and surface-active compounds based on multifunctional alcohols having at least three hydroxyl groups.

The use according to the invention of said additives results in a significant reduction in the disadvantages which occur on electrolytic deposition of zinc or zinc alloys at high current densities, in particular in an improvement in the surface roughness and dendritic edge growth.

In general, the metals to be galvanized are iron or iron-containing metals, in particular steel.

The process according to the invention also enables the deposition of zinc alloys through addition of corresponding metal salts to the electrolyte. Examples of suitable metal salts are chromium salts and nickel salts, which are preferably employed in the form of their sulfonates and/or alkanesulfonates.

In a preferred embodiment of the process according to the invention, the electrolyte comprises an alkanesulfonic acid.

For the purposes of the present invention, the term alkanesulfonic acids is taken to mean aliphatic sulfonic acids. These may, if desired, be substituted on their aliphatic radical by functional groups or, hetero atoms, for example hydroxyl groups. Preference is given to alkanesulfonic acids of the general formulae $$R—SO_3H \text{ or } HO—R'—SO_3H.$$

In these formulae, R is a hydrocarbon radical, which may be branched or unbranched, having 1 to 12 carbon atoms, preferably having 1 to 6 carbon atoms, particularly preferably an unbranched hydrocarbon radical having 1 to 3 carbon atoms, very particularly preferably having 1 carbon atom, i.e. methanesulfonic acid.

R' is a hydrocarbon radical, which may be branched or unbranched, having 2 to 12 carbon atoms, preferably having 2 to 6 carbon atoms, particularly preferably an unbranched hydrocarbon radical having 2 to 4 carbon atoms, where the hydroxyl group and the sulfonic acid group may be bonded to any desired carbon atoms, with the restriction that they are not bonded to the same carbon atom.

The alkanesulfonic acid employed in accordance with the invention is very particularly preferably methanesulfonic acid.

The alkanesulfonic acid employed, in particular methanesulfonic acid, facilitates good conductivity of the electrolyte, high possible current densities and very good throw on deposition of zinc or zinc alloys.

In a preferred embodiment of the process according to the invention, the electrolyte comprises either an alkanesulfonic acid as the only acid or a mixture of sulfuric acid and alkanesulfonic acid. The electrolyte preferably comprises from 10 to 100 parts by weight of an alkanesulfonic acid and from 90 to 0 parts by weight of sulfuric acid, where the sum of alkanesulfonic acid and sulfuric acid is 100 parts by weight and makes up a concentration of from 0 to 5% by weight, preferably from 0.5 to 3% by weight, of the electrolyte. The electrolyte particularly preferably comprises from 10 to 90 parts by weight of an alkanesulfonic acid and from 90 to 10 parts by weight of sulfuric acid, very particularly preferably from 20 to 80 parts by weight of an alkanesulfonic acid and from 80 to 20 parts by weight of sulfuric acid. However, it is likewise possible to use alkanesulfonic acid as the only acid in the electrolyte.

The electrolytes employed in the process according to the invention can be employed in a broad pH range of, in general, from >0.5 to 5. The process according to the invention is preferably carried out at pH values of from about 2.7 to 4, particularly preferably from 3 to 3.5. Optimum surface roughness and no or only little dendritic edge growth are also observed at low pH values.

In a preferred embodiment of the process according to the invention, the electrolyte comprises at least one alkanesulfonate of zinc. It is also possible to employ a mixture of an alkanesulfonate of zinc and zinc sulfate here. Through the use of soluble positive electrodes, the zinc salt or the zinc alloy salt can be re-formed during the electrolysis.

For the purposes of the present invention, the term alkanesulfonates is taken to mean aliphatic sulfonates. These may, if desired, be substituted on their aliphatic radical by functional groups or hetero atoms, for example hydroxyl groups. Preference is given to alkanesulfonates of the general formulae $$R—SO_3— \text{ or } HO—R'—SO_3—.$$

In these formulae, R is a hydrocarbon radical, which may be branched or unbranched, having 1 to 12 carbon atoms, preferably having 1 to 6 carbon atoms, particularly preferably an unbranched hydrocarbon radical having 1 to 3 carbon atoms, very particularly preferably having 1 carbon atom, i.e. methanesulfonate.

R' is a hydrocarbon radical, which may be branched or unbranched, having 2 to 12 carbon atoms, preferably having 2 to 6 carbon atoms, particularly preferably an unbranched hydrocarbon radical having 2 to 4 carbon atoms, where the hydroxyl group and the sulfonate group may be bonded to any desired carbon atoms, with the restriction that they are not bonded to the same carbon atom.

Zinc methanesulfonate is very particularly preferably employed in the process according to the invention.

The zinc salt, selected from zinc sulfate and/or an alkanesulfonate, preferably methanesulfonate, is generally present in the corresponding electrolyte in an amount of from >5 g/l to the saturation concentration of the corresponding zinc salt (or mixture). The corresponding zinc salt (or mixture) is preferably employed in an amount of from 10 to 250 g/l, preferably from 30 to 250 g/l, particularly preferably from 50 to 150 g/l, very particularly preferably from 75 to 100 g/l, based on the weight of the zinc, calculated as g of $Zn^{2+}$ per liter of electrolyte.

The process according to the invention is particularly suitable for electrolytic deposition of zinc at high current densities, i.e. for high-speed deposition of zinc, preferably for continuous galvanization.

In general, the process according to the invention is suitable for a current density range of from 10 to 500 A/dm$^2$, preferably from 20 to 400 A/dm$^2$, particularly preferably from 20 to 300 A/dm$^2$. The current densities used are dependent, inter alia, on the area of application.

In a typical process for the electrolytic strip galvanization of steel, for example for the automobile industry, Continuous coating is carried out at a current density of from 50 to 250 A/dm$^2$, giving a zinc surface having a thickness of from 6 to 10 $\mu$m. In this process, the steel to be coated is passed over conductive rolls. Adjacent to these rolls, zinc positive electrodes are generally dipped into the electrolysis bath, but insoluble positive electrodes can also be used.

The coating of tubes is generally carried out at current densities of from 10 to 75 A/dm$^2$, and a layer thickness of the zinc surface of from 0.2 to 20 $\mu$m is obtained. In general, the workpiece is passed continuously through the electrolysis bath.

Wire coating is generally carried out in a similar way to the coating of tubes. The current density is generally from 10 to 100 A/dm$^2$, and the layer thickness of the zinc surface is from 3.0 to 100 $\mu$m.

The high-speed deposition of zinc is generally carried out at temperatures of from room temperature (25° C.) to 75° C., preferably from 40 to 70° C.

The additives employed in the process according to the invention for improving the surface roughness and preventing dendritic edge growth are selected from nitrogen-containing surface-active compounds, which may be ionic or nonionic, sulfur-containing anionic surface-active compounds, and surface-active compounds based on multifunctional alcohols having at least three hydroxyl groups.

These surface-active compounds are suitable both for use in electrolytes containing sulfuric acid as the only acid in the electrolyte and for use in electrolytes containing alkanesulfonic acids, preferably methanesulfonic acid, and also for use in electrolytes comprising an alkanesulfonic acid, preferably methanesulfonic acid, as the only acid. The additives are preferably employed in electrolytes comprising an alkanesulfonic acid, either as a mixture with sulfuric acid or as the only acid.

The surface-active compounds employed in accordance with the invention can be employed individually or as mixtures of two or more surface-active compounds. In addition, further additives which are usually employed, such as conductive salts, may be employed in the electrolyte. However, very good zinc surfaces, in particular with respect to the surface roughness of the zinc surface and dendritic edge growth, are obtained even without addition of further conventional additives if alkanesulfonic acid is employed.

The surface-active compounds employed in accordance with the invention are, in addition to the positive influences, in particular, on the surface roughness of the zinc surface and on dendritic edge growth, furthermore distinguished through the fact that they have only a low foaming tendency. This property is of great importance for carrying out electrolytic galvanization on an industrial scale.

The surface-active compounds employed in accordance with the invention allow optimum surface roughness (Ra) of in general, from 0.3 to 3 $\mu$m, preferably from 1 to 2 $\mu$m, to be established. Uniformly thick, well-adhering zinc layers are obtained. The layer thickness of the zinc surfaces obtained by the process according to the invention is variable, depending on the desired application. Usual layer thicknesses are generally from 0.1 to 100 $\mu$m, preferably from 1 to 20 $\mu$m, particularly preferably from 5 to 10 $\mu$m. The layer thicknesses to be produced are dependent on the area of application, the particularly preferred embodiment applying to continuous strip galvanization.

The additives employed in accordance with the invention are employed in an amount of from 0.1 to 20 g/l, preferably from 0.5 to 10 g/l, particularly preferably from 1 to 6 g/l.

In a preferred embodiment of the process according to the invention, the nitrogen-containing surface-active compounds, which may be ionic (in which case the nitrogen itself may also be quaternized) or nonionic, employed as additives can be selected from polyethyleneimines and products of the reaction of amines with epichlorohydrin.

The polyethyleneimines may have either high molecular weight or low molecular weight, with mean molecular weights of from 400 to 1,000,000, where low-molecular-weight polyethyleneimines having mean molecular weights of from 600 to 5000 are preferred. They are generally prepared by conventional methods. In particular, the polyethyleneimines are preferably employed in electrolytes comprising an alkanesulfonic acid, preferably methanesulfonic acid. Suitable polyethyleneimines are the grades Lugalvan® G 15000, Lugalvan® G 20 and Lugalvan® G 35.

The products of the reaction of amines with epichlorohydrin are particularly preferably employed in the process according to the invention. Suitable amines are heterocyclic amines, in particular heterocyclic 5-membered rings, such as pyrrole, pyrazole and imidazole, amines which are substituted by aliphatic radicals, or, if desired, by hydrogen (in the case of the use of primary or secondary amines), where the aliphatic radicals may be identical or different, branched or unbranched, saturated or unsaturated and may be substituted by further hetero atoms. Preference is given to aliphatic radicals having 1 to 8 carbon atoms, particularly preferably having 1 to 5 carbon atoms. Particular preference is given to dimethylaminopropylamine and imidazole. The additives employed are very particularly preferably the products of the reaction of imidazole with epichlorohydrin. The products of the reaction of epichlorohydrin can be crosslinked using suitable crosslinking agents after their reaction. Of these additives, the products obtained in a 0.3:1 to 1:0.3% by weight reaction, preferably in a 0.5:1 to 1:0.5% by weight reaction, of imidazole and epichlorohydrin are particularly preferred. Preference is furthermore given to products of the reaction of dimethylaminopropylamine with epichlorohydrin which are, in particular, crosslinked after the reaction, for example by means of bisdichloroethane ether. Even as the only additives in the electrolytes employed in the process according to the invention, these products of the reaction of an amine with epichlorohydrin cause an improvement in the surface roughness and a reduction or prevention of dendritic edge growth. Suitable commercially available products are the grades Lugalvan® IZE 2 and Lugalvan® IZE 3 from BASF AG and MIRAPOL® WT from Rhodia.

Preferred sulfur-containing anionic surface-active compounds employed as additives are selected from sulfates, preferably ether sulfates or alkyl sulfates having at least 5 carbon atoms, for example ethylhexyl sulfate (for example Lutensit® TC-EHS From BASF AG), sulfonates, preferably products of the reaction of propanesultone (for example the Ralufong grades from Raschig), and isethionates (from example Lutensit® A-IS from BASF AG).

Preferred ether sulfates employed are $C_5$- to $C_{12}$-phenol polyglycol ether sulfates and fatty alcohol polyglycol ether sulfates. The sodium salts of octylphenol polyglycol ether sulfate, nonylphenol polyglycol ether sulfate and fatty alcohol polyglycol ether sulfate, which are available under the tradenames Emulphor® OPS 25, Emulphor® NPS 25 and Emulphor® FAS 30 from BASF AG, are particularly preferred.

Preferred products of the reaction of propanesultone are sulfopropyl ethers having 6 to 20 carbon atoms in the alkyl chain or having an aryl group which may be alkylated with an alkyl radical having 6 to 15 carbon atoms. These sulfopropyl ethers may furthermore contain from 3 to 20 ethylene oxide units. Particular preference is given to sulfopropyl ethers of the Ralufon® grades from Raschig, in particular Ralufon® F, Ralufon® N, Ralufon® NAPE 14 to 90, Ralufon® EA 15 to 90. These additives are preferably employed in electrolytes containing an alkanesulfonic acid.

Preferred surface-active compounds based on multifunctional alcohols having at least three carboxyl groups which are employed as additives are selected from $C_4$- to $C_{12}$-polyols having 3 to 12 hydroxyl groups, each of which are linked to different carbon atoms. Preference is given to sorbitol, which may be alkoxylated, preferably ethoxylated. Particular preference is given to multi-functional alcohols which have been ethoxylated with from 12 to 60 ethylene oxide units.

Suitable apparatuses and electrodes for electrolytic galvanization by the process according to the invention are generally dependent on the particular area of application (for example tube, strip or wire galvanization). In principle, the process according to the invention can be carried out in all conventional apparatuses and with all conventional electrodes.

The present invention furthermore relates to an electrolyte composition for electrolytic coating of metals with zinc or zinc alloys, comprising a zinc salt and, if desired, further metal salts, an acid selected from sulfuric acid or an alkanesulfonic acid or a mixture of the two acids and at least one additive selected from nitrogen-containing surface-active compounds, which may be ionic or nonionic, sulfur-containing surface-active compounds, and surface-active compounds based on multifunctional alcohols having at least three hydroxyl groups.

This electrolyte composition is particularly suitable for high-speed deposition of zinc or zinc alloys onto metals at high current densities. On use of this electrolyte compositions according to the invention, the disadvantages of high-speed deposition which are known from the prior art, in particular high surface roughness and dendritic edge growth, can be reduced or prevented. Suitable metals, electrolysis conditions, acids and zinc salts have already been mentioned above.

Preference is given to an electrolyte composition comprising additives selected from polyethyleneimines and products of the reaction of amines with epichlorohydrin, sulfates, preferably ether sulfates or alkyl sulfates having at least 5 carbon atoms, for example ethylhexyl sulfate, sulfonates, preferably products of the reaction of propanesultone, and isethionates and sorbitol, which may be alkoxylated, preferably ethoxylated. Particularly preferred additives have already been mentioned above.

The present invention furthermore relates to the use of compounds selected from nitrogen-containing surface-active compounds, which may be ionic or nonionic, sulfur-containing anionic surface-active compounds and surface-active compounds based on multifunctional alcohols having at least three hydroxyl groups as additives for improving the surface roughness and preventing dendritic edge growth in the electrolytic coating of metals with zinc or a zinc alloy in an electrolyte comprising an alkanesulfonic acid. Suitable metals, electrolysis conditions, zinc salts and preferred additives have already been mentioned above.

The electrolyte compositions comprising these additives are used, in particular, in the electrolytic continuous high-speed deposition of zinc or zinc alloys onto metals containing iron, in particular onto steel. Preferred areas of application are strip galvanization, for example for the production of steel sheeting galvanized on one or both sides for the automobile industry, the production of galvanized steel pipes and belts, and for the production of galvanized wires.

The examples below additionally explain the invention.

Mode(s) of Carrying out the Invention

EXAMPLES

In order to investigate the effect of electrolyte acid and additives on the quality of the deposited zinc layers with respect to dendrite growth, edge burn, roughness, layer structure, etc., experiments were carried out in the so-called Hull cell. The deposition here can be assessed in a broad current density range. Furthermore, experiments were carried out in order to investigate the foam formation of the electrolyte, and experiments were carried out with considerable relative movement of electrolyte and metal sheet to one another in order to investigate possible current densities in high-speed deposition.

The zinc salts employed were zinc sulfate and zinc methanesulfonate, the latter being obtained by reacting zinc carbonate with methanesulfonic acid. All the experiments were carried out at 55° C., the deposition time was 84 s, the mean current density was 20 A/dm$^2$, giving current densities of >100 A/dm$^2$ in the edge region of the metal sheet to be coated.

Example 1 a) Comparative Experiment

An electrolyte comprising 396 g/l of $ZnSO_4 \times 7\ H_2O$ and 25 g/l of $H_2SO_4$ (100%) was prepared. The pH was adjusted to 1.1 by means of NaOH. This base electrolyte was used, as described above, for the deposition of zinc onto a steel sheet measuring 10×7 cm.

b) Experiment According to the Invention

A similar electrolyte, but with an additional 2 g/l of Lugalvan® IZE 2, was employed under identical conditions.

Figure 1A:
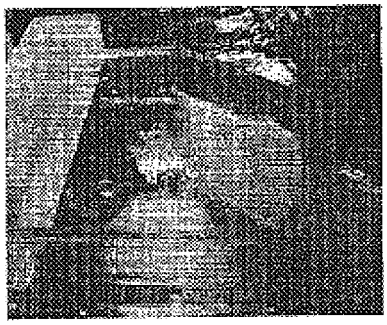
FIGS. 1 to 19 illustrate the impact of the additive on dendrite growth, surface roughness and throw and buring tendencies.
Figure 1B:
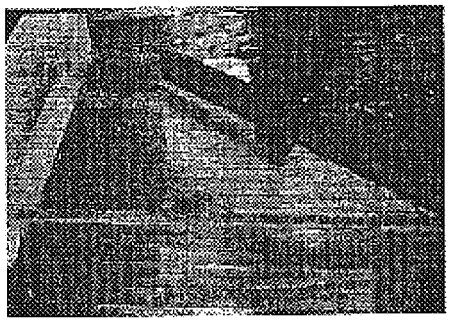

FIG. 1 shows the dendrite growth in an electrolyte according to Example 1 a) without additive;
b) with addition of Lugalvan® IZE 2.

Figure 2A:
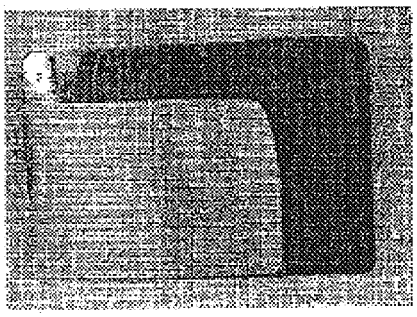
Figure 2B:
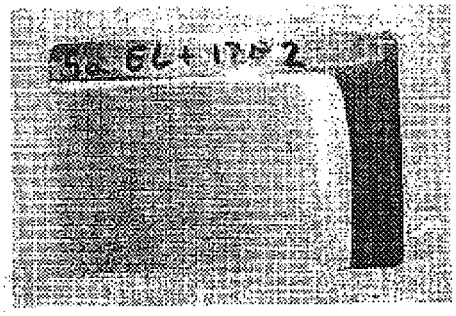

FIG. 2 shows the throw and the burning tendency in an electrolyte according to Example 1 a) without additive;
b) with addition of Luvalvan® IZE 2.

Figure 3A:
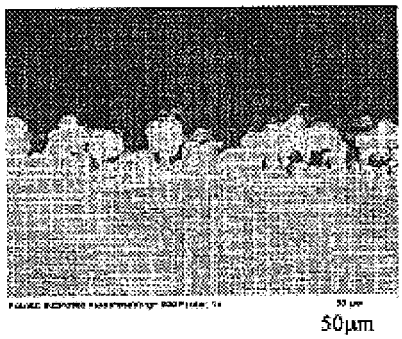
Figure 3B:
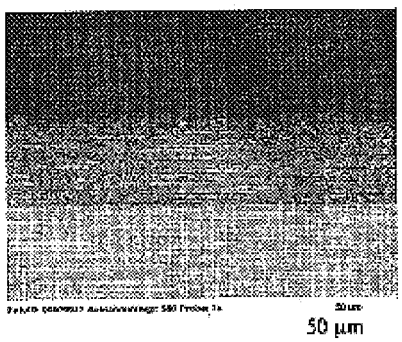

The polished section images in FIG. 3 show the uniformity of the zinc layers (surface roughness) in an electrolyte according to Example 1 a) without additive;
b) with addition of Lugalvan® IZE 2.

As can be seen in the attached figures, the addition of Lugalvan® IZE 2 causes drastically reduced dendrite growth, better throw and a significantly more uniform and closed zinc layer even in the high current density range, where the layer thickness was about 40 $\mu$m.

Example 2 a) Comparative Experiment

An electrolyte comprising 396 g/l of $ZnSO_4 \times 7\ H_2O$ and 17.5 g/l of $H_2SO_4$ (100%) and 7.5 g/l of methanesulfonic acid (100%) was prepared. The pH was adjusted to 1.1 by means of NaOH. This base electrolyte was used, as described above, for the deposition of zinc onto a steel sheet measuring 10×7 cm.

b) Experiment According to the Invention

A similar electrolyte, but with an additional 2 g/l of Lugalvan® IZE 3, was employed under identical conditions.

Figure 4A:
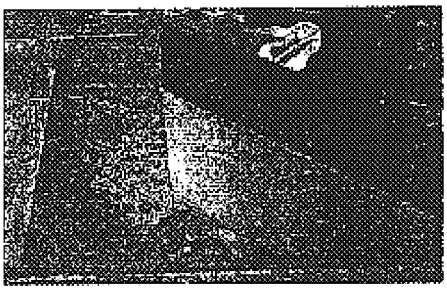
Figure 4B:
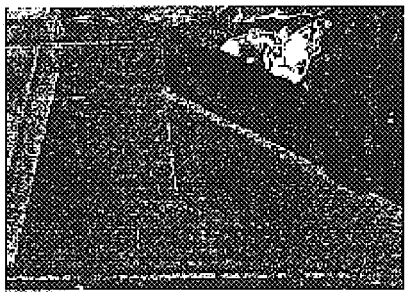

FIG. 4 shows the dendrite growth in an electrolyte according to Example 2 a) without additive;
b) with addition of Lugalvang IZE 3.

Figure 5A:
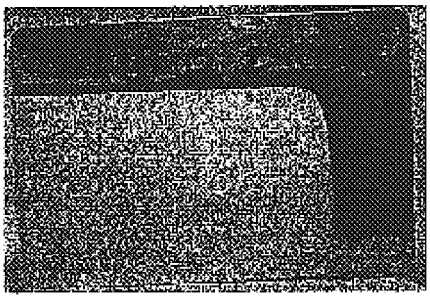
Figure 5B:
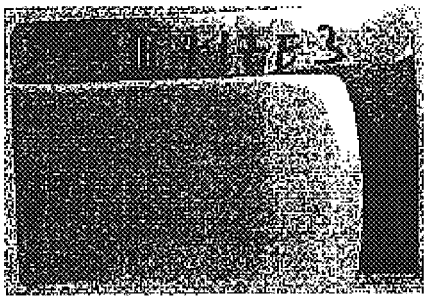

FIG. 5 shows the throw and the burning tendency in an electrolyte according to Example 2 a) without additive;
b) with addition of Luvalvan® IZE 3.

The polished section images in FIG. 6 show the uniformity of the zinc layers (surface roughness) in an electrolyte according to Example 2 a) without additive;
b) with addition of Lugalvan® IZE 3.

Figure 6A:
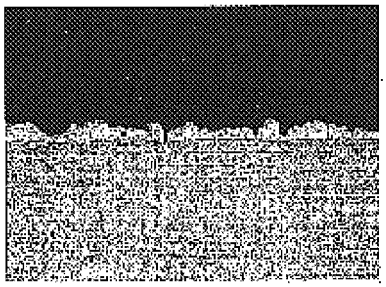
Figure 6B:
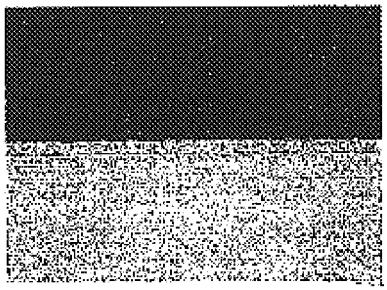

It can be seen from the attached figures that better throw and reduced edge burn are obtained in Example 2 compared with Example 1 even without the additive. The addition of Lugalvan® IZE 3 effectively prevents dendritic growth and improves throw further. It can be seen from the polished section images in FIG. 6 that, in the moderate current density range, a zinc layer with a thickness of approximately 7 $\mu$m was obtained which appears uniform and smooth with the additive (FIG. 6*b*), while an uneven layer with some pores extending down to the steel substrate is obtained without the additive (FIG. 6*a*).

Example 3 a) Comparative Experiment

An electrolyte comprising 75 g/l of $Zn^+$ as zinc methanesulfonate (prepared from zinc carbonate and methanesulfonic acid) was prepared. The pH was adjusted to 3. An electrolyte of this type was used for the deposition of zinc as in Example 1 and 2.

b) Experiment According to the Invention

A similar electrolyte, but with an additional 2 g/l of Lugalvan® IZE 2, was employed under identical conditions.

Figure 7A:
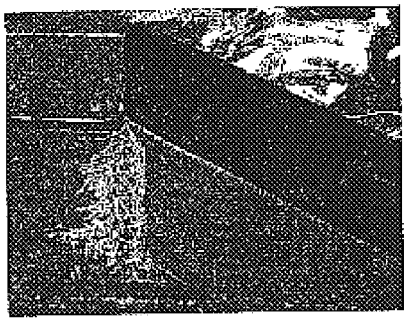
Figure 7B:
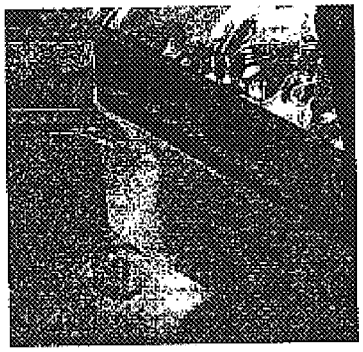

FIG. 7 shows the dendrite growth in an electrolyte according to Example 3 a) without additive;
b) with addition of Lugalvan® IZE 2.

Figure 8A:
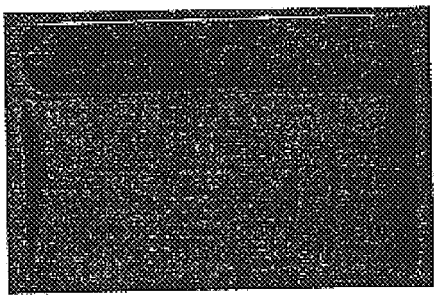
Figure 8B:
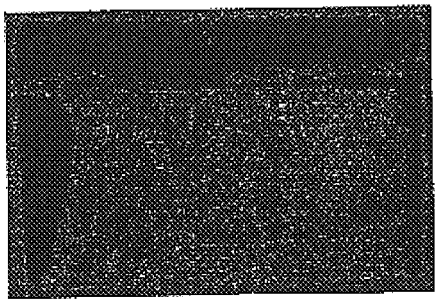

FIG. 8 shows the throw and the burning tendency in an electrolyte according to Example 3 a) without additive;
b) with addition of Luvalvan® IZE 2.

Figure 9A:
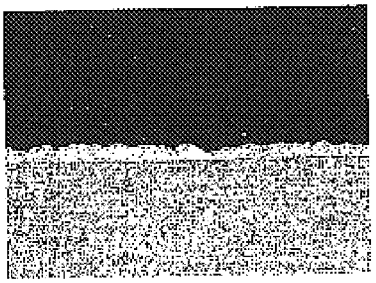
Figure 9B:
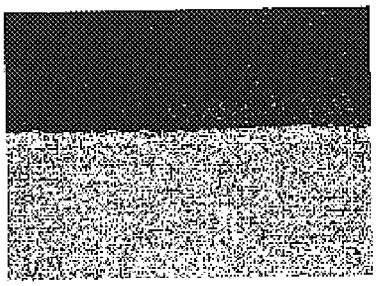

The polished section images in FIG. 9 show the uniformity of the zinc layers (surface roughness) in an electrolyte according to Example 3 a) without additive;
b) with addition of Lugalvan® IZE 2.

As can be seen from the attached figures, the throw is already very good even with the electrolyte without additive, but an additive is required to prevent dendritic growth (see FIG. 7). It can furthermore be seen from the polished section images (FIG. 9) that the additive causes a significant reduction in roughness of the layer with a thickness of approximately 8 $\mu$m.

Example 4

2 g/l of Lugalvan® G20 were added to the base electrolyte from Example 1. Comparable results were obtained as in Example 1 on addition of Lugalvan® IZE 3.

Figure 10:
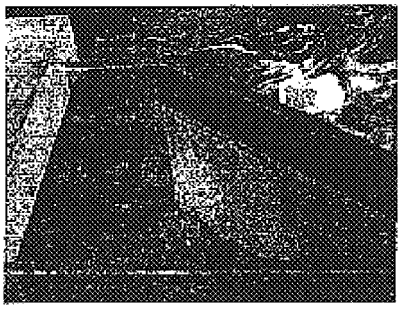

FIG. 10 shows the dendrite growth in an electrolyte according to Example 1 with addition of Lugalvan® G20.

Figure 11:
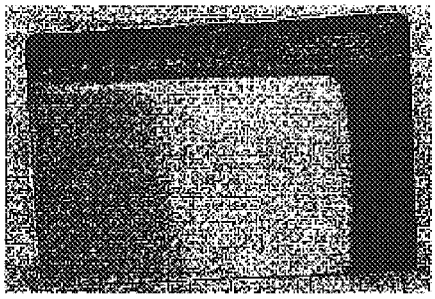

FIG. 11 shows the throw and the burning tendency in an electrolyte according to Example 1 with addition of Lugalvan® G20.

Example 5

2 g/l of Mirapolg WT were added to the base electrolyte from Example 2. Comparable results were obtained as in Example 2 on addition of Lugalvan® IZE 3.

Figure 12:
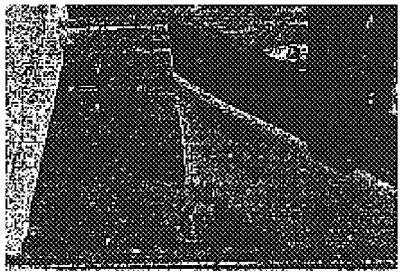

FIG. 12 shows the dendrite growth in an electrolyte according to Example 2 with addition of Mirapol® WT.

Figure 13:
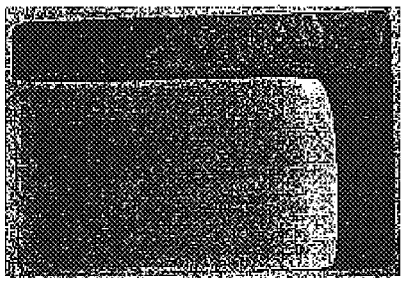

FIG. 13 shows the throw and burning tendency in an electrolyte according to Example 2 with addition of Mirapolg WT.

Example 6

4 g/l of ethoxylated sorbitol (24 ethylene oxide units) were added to the base electrolyte from Example 3. Comparable results were obtained as with the addition of Lugalvan® IZE 2 in Example 3. Burn and dendrite growth were very low and throw was very good.

Figure 14:
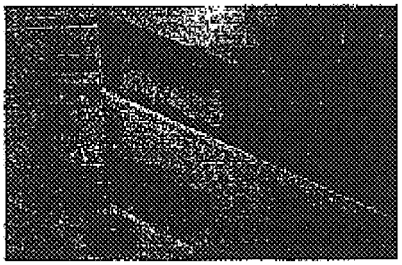

FIG. 14 shows the dendrite growth in an electrolyte according to Example 3 with addition of ethoxylated sorbitol.

Figure 15:
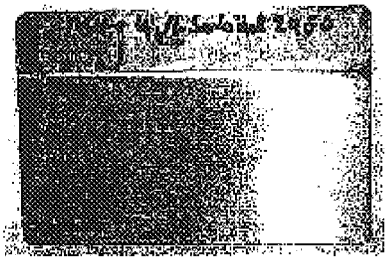

FIG. 15 shows the throw and the burn tendency in an electrolyte according to Example 3 with addition of ethoxylated sorbitol.

Example 7

4 g/l of Lutensit® A-IS (isethionate) were added to the base electrolyte from Example 3. Burning was very low and dendrite growth was moderate, and deposition was very uniform.

Figure 16:
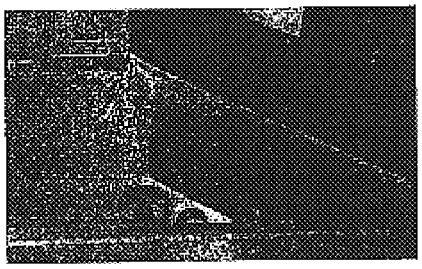

FIG. 16 shows the dendrite growth in an electrolyte according to Example 3 with addition of Lutensit® A-IS.

Figure 17:
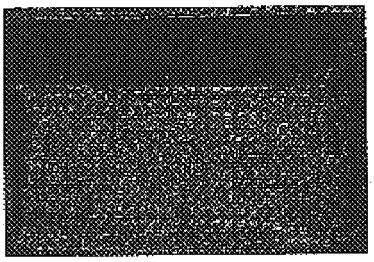

FIG. 17 shows the throw and the burn tendency in an electrolyte according to Example 3 with addition of Lutensit® A-IS.

Example 8

2 g/l of Lugalvan® IZE 2 and 4 g/l of Lutensit® TC-EHS were added to the base electrolyte from Example 3. Comparable results were obtained as with addition of Lugalvan® IZE 2. The burn was lower compared with Lugalvan® IZE 2 alone, and no dendrite growth was evident, throw was very good and deposition was very uniform.

Figure 18:
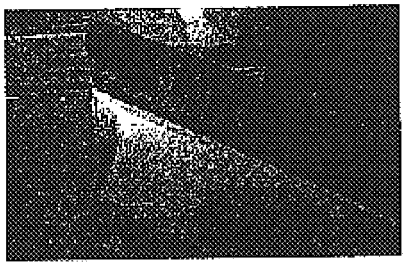

FIG. 18 shows the dendrite growth in an electrolyte according to Example 3 with addition of Lugalvan® IZE 2 and Lutensit® TC-EHS.

Figure 19:
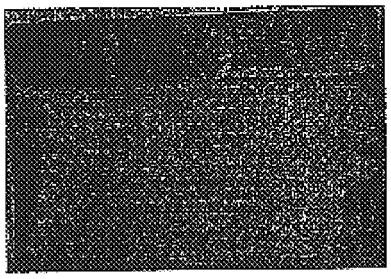

FIG. 19 shows the throw and the burn tendency in an electrolyte according to Example 3 with addition of Lugalvan® IZE 2 and Lutensit® TC-EHS.

We claim:

1. A process for the electrolytic coating of metals with zinc or a zinc alloy at a current density of from 10 to 400 $A/dm^2$ in which matt surfaces are obtained, which comprises electrodepositing zinc from an electrolyte solution comprising a) a zinc salt selected from zinc sulfate, an alkanesulfonate of zinc or mixtures thereof, and optionally further metal salts, b) an alkanesulfonic acid or a mixture of an alkanesulfonic acid and sulfuric acid, and c) at least one additive for improving the surface roughness and preventing dendritic edge growth, selected from the group consisting of polyethyleneimines, products obtained by reacting amines with epichlorohydrin, alkyl sulfates having at least 5 carbon atoms, sulfonates, and isethionates, without addition of further conventional additives.

2. A process as claimed in claim 1, wherein the alkanesulfonic acid is methanesulfonic acid.

3. A process as claimed in claim 1, wherein the process is carried out at a pH of from 0.5 to 5.

4. A process as claimed in claim 3, wherein the process is carried out at a pH of from 2.7 to 4.

5. A process as claimed in claim 3, wherein the pH is from 1.1 to 3.5.

6. A process as claimed in claim 1, wherein the alkanesulfonate of zinc is the methanesulfonate of zinc.

7. A process as claimed in claim 1, wherein the zinc salt is employed in an amount of from 30 to 250 g/l, calculated as zinc.

8. A process as claimed in claim 1, wherein the current density is of from 20 to 300 $A/dm^2$.

9. A process as claimed in claim 1, wherein the reaction products of the amines with epichlorohydrin are 0.3:1 to 1:0.3% by weight products obtained by reacting a secondary amine and epichlorohydrin.

10. A process as claimed in claim 1, wherein the alkylsulfate having at least 5 carbon atoms is ethylhexyl sulfate or wherein the sulfonate is a sulfonate obtained by reacting propanesultone.

11. A process as claimed in claim 1, wherein the sulfonate is a sulfonate obtained by reacting propanesultone.

12. A process as claimed in claim 11, wherein the sulfonate is selected from sulfopropyl ethers having an alkyl group of 6 to 20 carbon atoms, or sulfopropyl ethers having an aryl group which is optionally alkylated with an alkyl radical having 6 to 15 carbon atoms, and wherein the sulfopropyl ethers optionally further contain from 3 to 20 ethylene oxide units.

13. An electrolyte composition for electrolytic coating of metals with zinc or zinc alloys, comprising a) a zinc salt and optionally further metal salts, b) an alkanesulfonic acid or a mixture of an alkanesulfonic acid and sulfuric acid, and c) at least one additive selected from the group consisting of polyethyleneimines, products obtained by reacting amines with epichlorohydrin, alkyl sulfates having at least 5 carbon atoms, sulfonates, and isethionates, without addition of further conventional additives.

14. An electrolyte composition as claimed in claim 13, wherein the products obtained by reacting amines with epichlorohydrin are 0.3:1–to 1:0.3% by weight products obtained by reacting a secondary amine and epichlorohydrin, the alkyl sulfate having at least 5 carbon atoms is ethylhexyl sulfate, or the sulfonates are sulfonates obtained by reacting propansultone.

15. An electrolyte composition as claimed in claim 13, wherein the sulfonate is a sulfonate obtained by reacting propanesultone.

16. An electrolyte composition as claimed in claim 15, wherein the sulfonate is selected from sulfopropyl ethers having an alkyl group of 6 to 20 carbon atoms, or sulfopropyl ethers having an aryl group which is optionally alkylated with an alkyl radical having 6 to 15 carbon atoms, and wherein the sulfopropyl ethers optionally further contain from 3 to 20 ethylene oxide units.

* * * * *